US009345288B1

(12) United States Patent
Greenberg et al.

(10) Patent No.: US 9,345,288 B1
(45) Date of Patent: May 24, 2016

(54) USER CONFIGURABLE BELT BUCKLE

(71) Applicants: Hank Greenberg, Oceanside, NY (US); Gaspare J. Randazzo, Huntington, NY (US)

(72) Inventors: Hank Greenberg, Oceanside, NY (US); Gaspare J. Randazzo, Huntington, NY (US)

( * ) Notice: Subject to any disclaimer, the term of this patent is extended or adjusted under 35 U.S.C. 154(b) by 0 days.

(21) Appl. No.: 14/949,496

(22) Filed: Nov. 23, 2015

Related U.S. Application Data

(60) Provisional application No. 62/111,365, filed on Feb. 3, 2015.

(51) Int. Cl.

| | |
|---|---|
| ***A41F 9/00*** | (2006.01) |
| ***A44B 11/00*** | (2006.01) |
| ***A44B 11/24*** | (2006.01) |
| ***F21V 33/00*** | (2006.01) |
| *F21Y 101/02* | (2006.01) |

(52) U.S. Cl.
CPC ..... *A44B 11/005* (2013.01); *A44B 11/24* (2013.01); *F21V 33/0008* (2013.01); *F21Y 2101/02* (2013.01)

(58) Field of Classification Search
CPC .. A44B 11/24; A44B 11/223; Y10T 24/4037; Y10T 24/4065; Y10T 24/10; Y10T 24/3419; Y10T 24/3495; Y10T 24/40; Y10T 24/4016; Y10T 24/4026; Y10T 24/4072; Y10T 24/4098; Y10T 24/45; Y10T 24/4736; F16B 45/02
USPC ..... 24/1, 163 K, 163 R, 170, 174, 178, 188, 24/191, 265 BC, 265 WS, 320, 377, 572.1
See application file for complete search history.

(56) References Cited

U.S. PATENT DOCUMENTS

| | | | | |
|---|---|---|---|---|
| 1,478,659 | A * | 12/1923 | King | A44B 11/24 24/178 |
| 4,858,283 | A * | 8/1989 | Takeuchi | A44B 11/24 24/178 |
| 7,181,808 | B1 * | 2/2007 | Van Winkle | A44B 11/223 24/170 |
| 2012/0252965 | A1 * | 10/2012 | Coffman | C08L 59/02 524/566 |
| 2013/0139301 | A1 * | 6/2013 | Sartin | A44B 11/24 2/321 |

* cited by examiner

*Primary Examiner* — Robert J Sandy
*Assistant Examiner* — David Upchurch
(74) *Attorney, Agent, or Firm* — Gaspare J. Randazzo

(57) ABSTRACT

Various user configurable belt buckles are provided. A user configurable belt buckle includes a user configurable frame that, in turn, includes four side members. The user configurable belt buckle further includes a prong, secured to the user configurable frame, for protruding through a hole in a belt. The user configurable belt buckle also includes one or more user-controllable attachment devices for providing side member substitution. At least one side member of the four side members is user replaceable by a substitute side member having at least one different physical characteristic than the at least one side member.

29 Claims, 13 Drawing Sheets

USER CONFIGURABLE BELT BUCKLE

BACKGROUND

1. Technical Field

The present invention relates generally to clothing and, in particular, to a user-configurable belt buckle.

2. Description of the Related Art

Ways in which to hold up pants have spanned belts, ropes and other means. However, the functionality has always been fixed, namely to hold up the pants of a wearer. Moreover, the capabilities of belt buckles used with belts have always been limited to simply securing the belt portion without more.

SUMMARY

According to an aspect of the present principles, a user configurable belt buckle is provided. The user configurable belt buckle includes a user configurable frame that, in turn, includes four side members. The user configurable belt buckle further includes a prong, secured to the user configurable frame, for protruding through a hole in a belt. The user configurable belt buckle also includes one or more user-controllable attachment devices for providing side member substitution. At least one side member of the four side members is user replaceable by a substitute side member having at least one different physical characteristic than the at least one side member.

According to another aspect of the present principles, a user configurable belt buckle kit is provided. The user configurable belt buckle kit includes a user configurable frame including four side members. The user configurable belt buckle kit further includes a prong secured to the user configurable frame. The user configurable belt buckle kit also includes at least one of, at least one substitute side member and a substitute prong. The user configurable belt buckle kit additionally includes one or more user-controllable side attachment devices that provide side member substitution. The user configurable belt buckle kit further includes a user-controllable prong attachment that provides prong substitution. The prong and at least one side member of the four side members are user replaceable.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
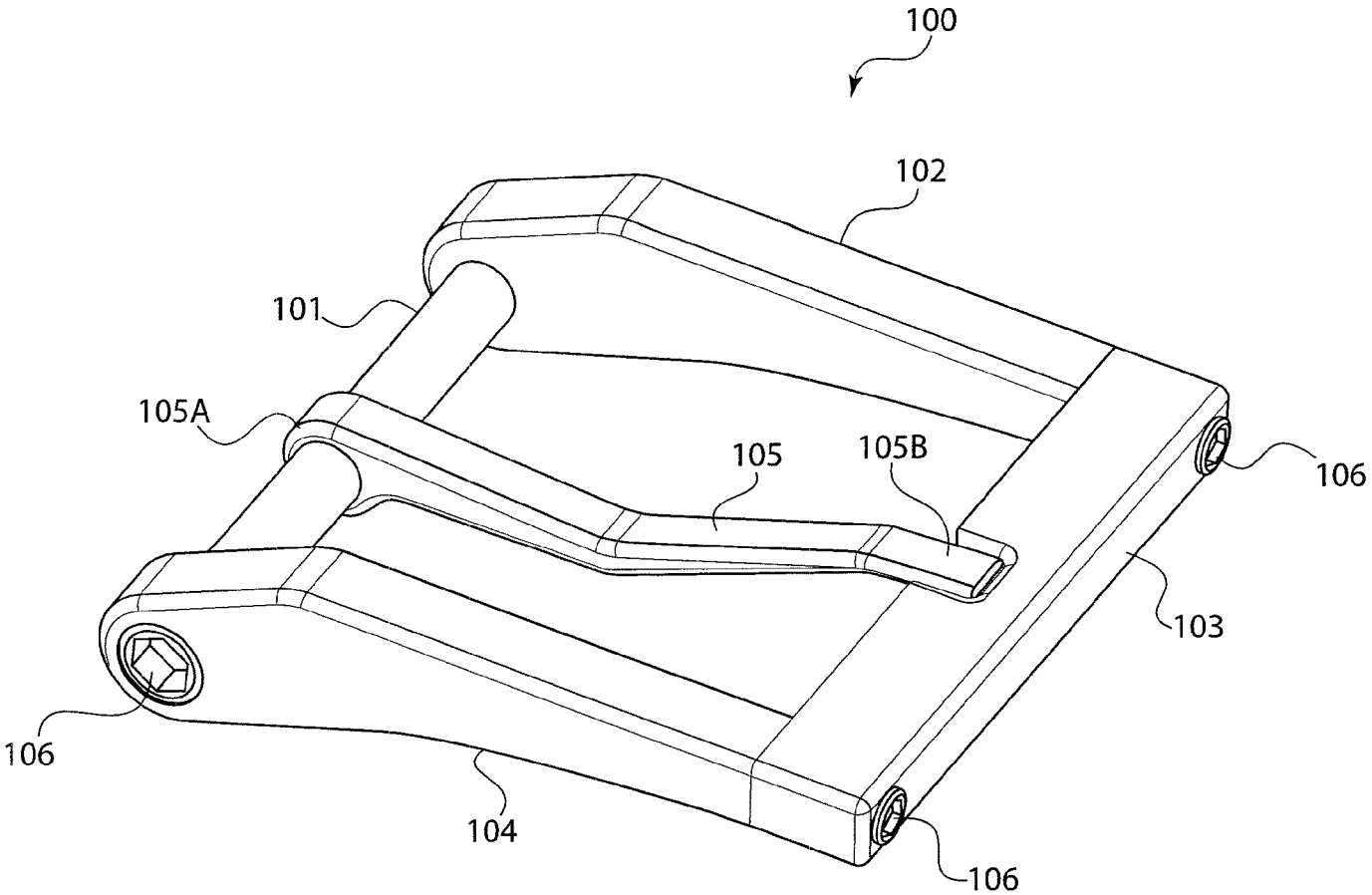
FIG. 1 is a perspective view showing an exemplary user configurable belt buckle 100, in accordance with an embodiment of the present principles.

The present principles are directed to a user configurable belt buckle. A user configurable belt buckle in accordance with the present principles allows for a portion(s) of the buckle (that is, element(s) of the buckle, including but not limited to, the sides, the prong, attachment devices, and features incorporating into the sides and/or prong) to be replaced with a replacement portion(s) that can have one or more different properties from the portion(s) it replaces including, but not limited to, shape, size, color, material, feature, and so forth. While the preceding are mentioned in a singular manner (e.g., shape versus shapes), it is to be appreciated that any given singular property (e.g., shape) of the replacement portion(s) can be different in more than one way. For example, a strictly rectangular shaped portion can be replaced with a portion that is partially cylindrical (e.g., at one end) and partially triangular (e.g., at the opposing end). A user configurable belt buckle in accordance with the present principles can allow for many different variations using replacement portions as described herein.

The preceding examples as well as the examples that follow are provided for the sake of illustration and should not be construed as limiting the present principles in any way, as readily appreciated by one of ordinary skill in the art, given the teachings of the present principles provided herein. Further to that end, it is to be appreciated that the overall dimensions, particular sizing of the individual portions, and relative proportions between the portions are merely illustrative and can readily varied, depending upon the particular implementation. Also, while various shapes and characteristics have been depicted herein regarding certain features of the user configurable belt buckle, other shapes and/or characteristics can also be used, while maintaining the spirit of the present principles.

Moreover, it is to be appreciated that a replacement portion can be separate from a particular embodiment of a user configurable belt buckle (e.g., four rectangle sides, and a separately provided side that is cylindrical) or can be included within that particular embodiment of the user configurable belt buckle (e.g., four sides, with the top being rectangular and the bottom being cylindrical, and where the top can be switched with the bottom to alter the appearance of the belt). In the preceding example, different colors, materials, and so forth can be used to further change the appearance of the buckle. Hence, embodiments of the present principles can include a singular and complete user configurable belt buckle that allows variation by swapping parts, or can be a kit that includes a complete user configurable belt buckle and additional replacement parts that can be readily swapped in to alter the look and/or functionality of the belt.

Regarding functionality, some embodiments of the present principles can involve a user configurable belt buckle having features beyond those relating to conventional buckles. Some example features include, a seat belt cutter, a bottle opener, a light, and so forth.

These and other variations and implementations of the present principles are readily determined by one of ordinary skill in the art, given the teachings of the present principles provided herein, while maintaining the spirit of the present principles.

Figure 2:
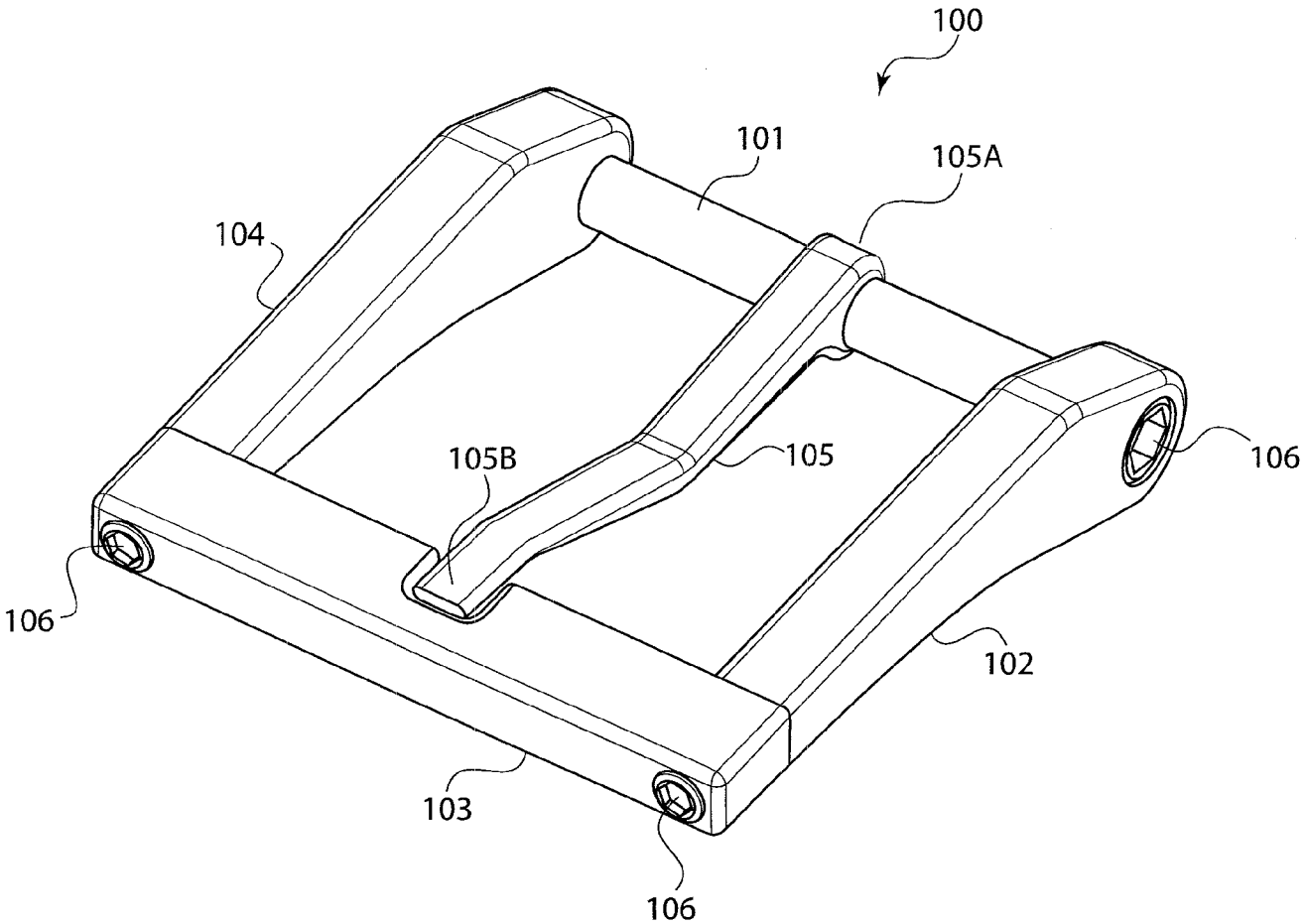
FIG. 2 is another perspective view showing the exemplary user configurable belt buckle 100 of FIG. 1, in accordance with an embodiment of the present principles.
Figure 3:
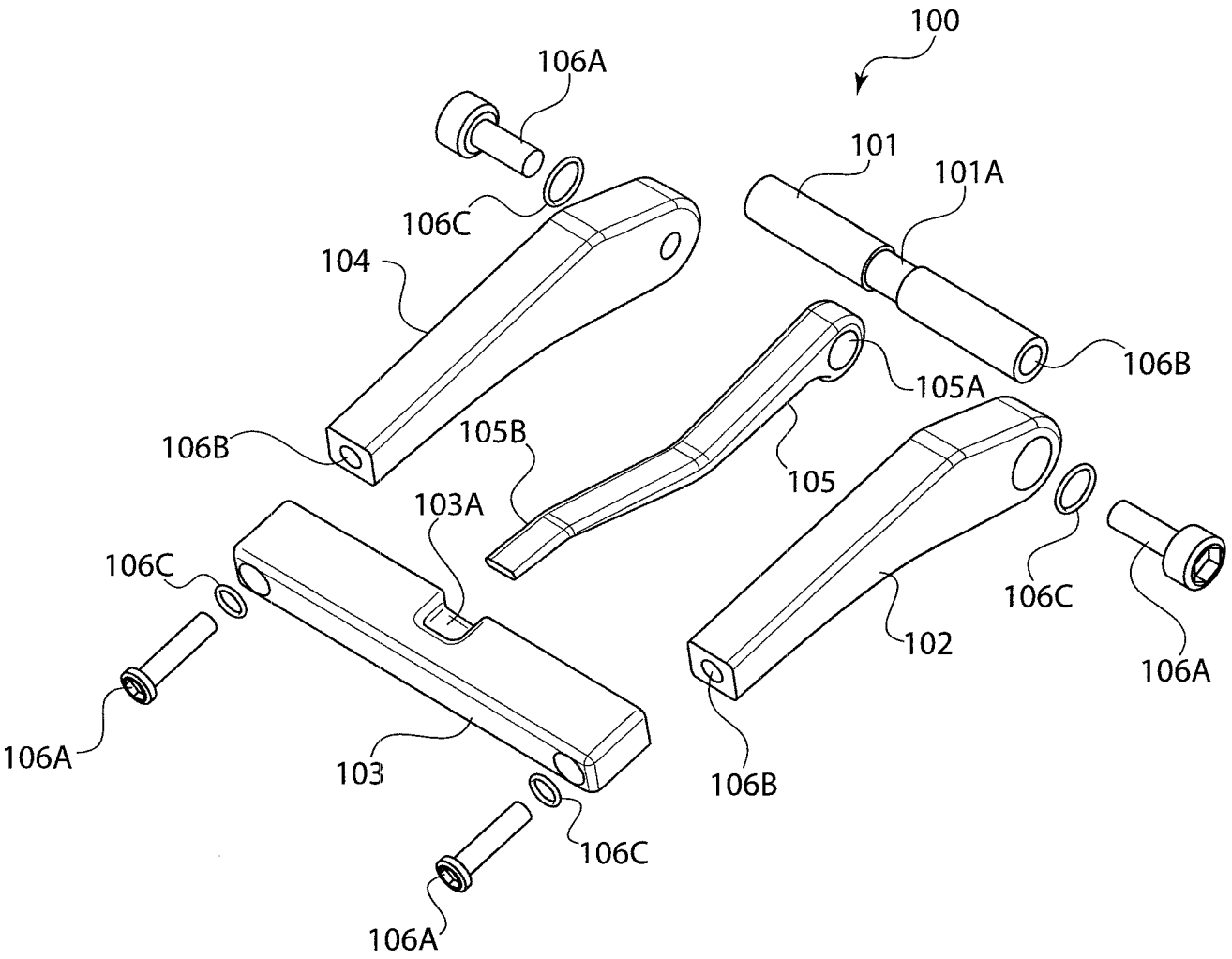
FIG. 3 is an exploded perspective view showing the exemplary user configurable belt buckle 100 of FIG. 1, in accordance with an embodiment of the present principles.
Figure 4:
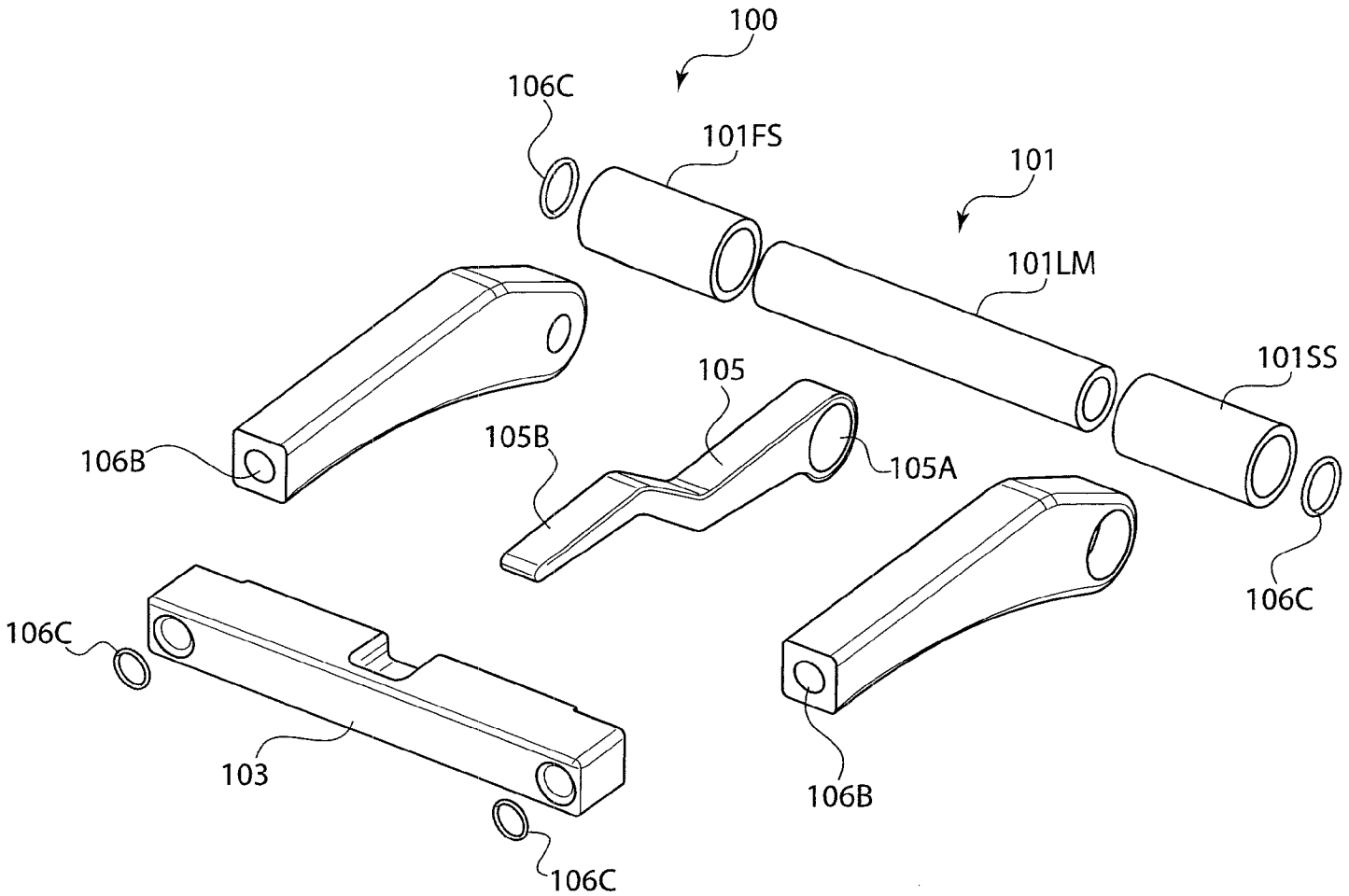
FIG. 4 is an exploded perspective view showing the exemplary user configurable belt buckle 100 of FIG. 1, in accordance with an embodiment of the present principles.

FIG. 1 is a perspective view showing an exemplary user configurable belt buckle 100, in accordance with an embodiment of the present principles. FIG. 2 is another perspective view showing the exemplary user configurable belt buckle 100 of FIG. 1, in accordance with an embodiment of the present principles. FIG. 3 is an exploded perspective view showing the exemplary user configurable belt buckle 100 of FIG. 1, in accordance with an embodiment of the present principles. FIG. 4 is another exploded perspective view showing the exemplary user configurable belt buckle 100 of FIG. 1, in accordance with an embodiment of the present principles. FIGS. 1-4 show a user configurable belt buckle in accordance with the present principles presented in three-dimensions. For the sake of simplicity, the drawings thereafter are shown in two dimensions.

In the embodiments of FIGS. 1-13, the user configurable belt buckle has a generally square or rectangular shape. Of course, other shapes can also be used, while maintaining the spirit of the present principles. Thus, the following naming conventions (e.g., left side, right side, top side, bottom side, etc.) used for elements of the buckle are merely illustrative and can vary depending upon the particular implementation. For example, a user configurable belt buckle with a generally triangular shape can use other names for the elements, as readily appreciated by one of ordinary skill in the art, while maintaining the spirit of the present principles. Hence, since the orientation of the user configurable belt buckle 100 in FIGS. 3-4 is flipped from that shown in FIGS. 1-2, the left side 101 shown in FIGS. 1-2 will appear on right side in FIGS. 3-4, and so forth for other implicated elements affected by the flipped orientation. It is noted that the Figures following FIGS. 3-4, except for FIG. 12, have the same orientation as shown in FIGS. 1-2. Nonetheless, the reference numerals enable the identification of the elements with respect to the detailed description of the present principles provided herein despite the naming conventions of the elements and their respective locations in the Figures.

The user configurable belt buckle 100 includes a left side 101, a top side 102, a right side 103, a bottom side 104, and a prong 105. The elements (e.g., 101, 102, 103, and 104) are interconnected using fasteners 106. In the embodiment of FIG. 3, the fasteners 106 include screws 106A and screw receiving portions 106B. While the screws 106A and screw receiving portions 106B are shown having different sizes, the same sizes can be used in other embodiments. Of course, other fasteners can be used, including magnets, captive screws, and so forth. In an embodiment, an Allen key can be stored within a member of the buckle or attached to a member of the buckle (e.g., magnetically or using an attachment device, e.g., one in which the Allen key can snap into and out of). Additionally, or alternatively, a screwdriver of a type corresponding to the fasteners could be included or attached as described above for the Allen key. In an embodiment, O-rings 106C can be used to keep water, sand, and other materials out of the internals of the user configurable belt buckle 100. Such capability is particularly useful for embodiments that involve the inclusion of electronic elements (LED, battery, etc.) within the user configurable belt buckle 100. The preceding description regarding the fasteners 106 is for illustrative purposes and is not to be construed to be limiting of the present principles with regards to the fasteners that can be used to implement a user configurable belt buckle in accordance with the present principles.

In the embodiments of at least FIGS. 1-4, the left side 101 is cylindrical and is partially encapsulated along its circumference by a ring portion 105A disposed at one end of the prong 105 that allows the prong 105 to move so the opposing end 105B can be placed through a hole in a belt. The ring portion 105A maintains a same relative position along the longitudinal axis of the prong 105 by a cutout 101A on the left side 101 that prevent the ring portion 105A from moving up or down the longitudinal axis beyond such cutout 101A. Right side 103 can include a cutout 103A for receiving the opposing end 105B. The preceding is but one of many exemplary other ways in which to secure the prong 105 to the left side 101, as readily appreciated by one of ordinary skill in the related art. Of course, the present principles are not limited to such shapes, configurations, ways of movement, ways of belt attachment, and so forth, and other shapes, configurations, ways of movement, ways of belt attachment, and so forth can also be used while maintaining the spirit of the present principles.

Referring to FIG. 4, the same further illustrates how the prong 105 can be connected to the left side 101. Left side 101 includes one long member 101LM, a first short member 101FS, and a second short member 101SS. When the first short member 101FS and the second short member 101SS are placed on the long member 101LM, the cutout 101A is formed to encapsulate the ring 105A (noting, of course, that the ring 105A is to be slid on the long member 101LM in between the two short members 101FS and 101SS in order to encapsulate the ring 105 there between and, thus, maintain a relative fixed position of the prong 105 on the left side 101. That is, one of the short members is placed on the one long member, then the ring portion 105A, and then the other short member, where all of the two short members and the ring portion 105A encapsulate respective portions of left side 101 while maintaining a position of the ring portion 105A and hence the prong 105. It is to be appreciated that FIG. 4 shows one exemplary way in which the prong can be attached and positioned. Of course, the present principles are not limited to the preceding way and, thus, other ways to attach the prong (including using other structure and so forth) as well as other prong positions (e.g., non-central, and so forth) can also be used in accordance with the teachings of the present principles, while maintaining the spirit of the present principles.

Figure 5:
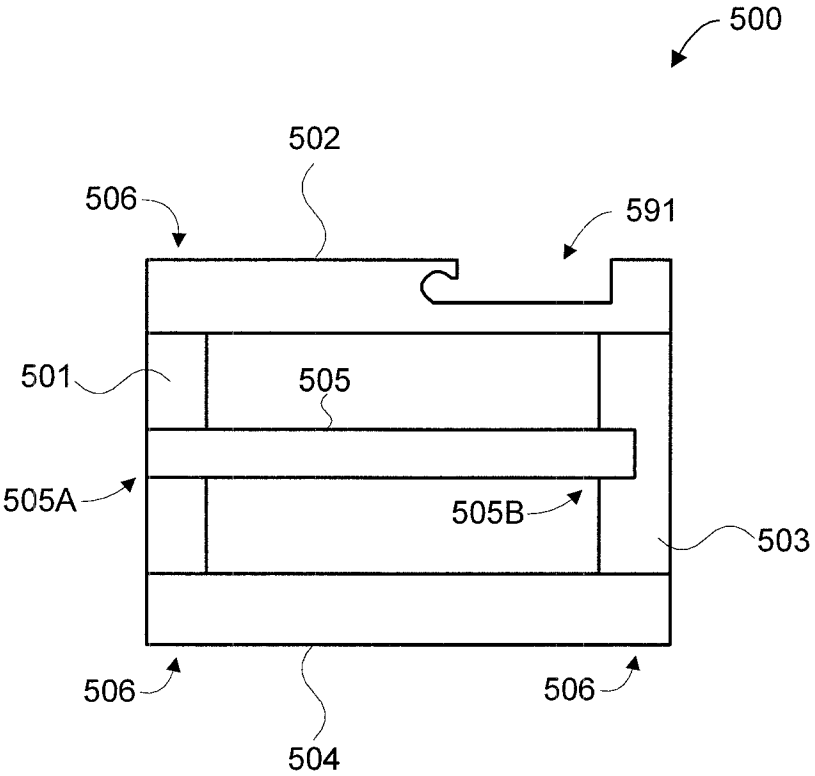
FIG. 5 is a diagram showing an exemplary user configurable belt buckle 500 having a seatbelt cutter 591, in accordance with an embodiment of the present principles.

FIG. 5 is a diagram showing an exemplary user configurable belt buckle 500, in accordance with an embodiment of the present principles. The user configurable belt buckle 500 includes a left side 501, a top side 502, a right side 503, a bottom side 504, and a prong 505. The elements (e.g., 501, 502, 503, and 504) are interconnected using fasteners 506 (not all fasteners are indicated in FIG. 5). Moreover, side 505A of prong 505 is attached to the left side 501, and side 505B of prong 505 goes through a hole in a corresponding belt in order to secure a desired belt length.

In the embodiment of FIG. 5, one side of the user configurable belt buckle 500 includes a feature. Specifically, the feature is a seatbelt cutter 591 on the top side 502. However, in other embodiments, the user configurable belt buckle can include one or more features on one or more portions (e.g., sides, prong). Accordingly, the user configurable belt buckle 500 provides the advantageous and potentially life-saving feature of a belt cutter 591 that can be used to cut a seat belt to thereby free a trapped occupant of a vehicle.

Figure 6:
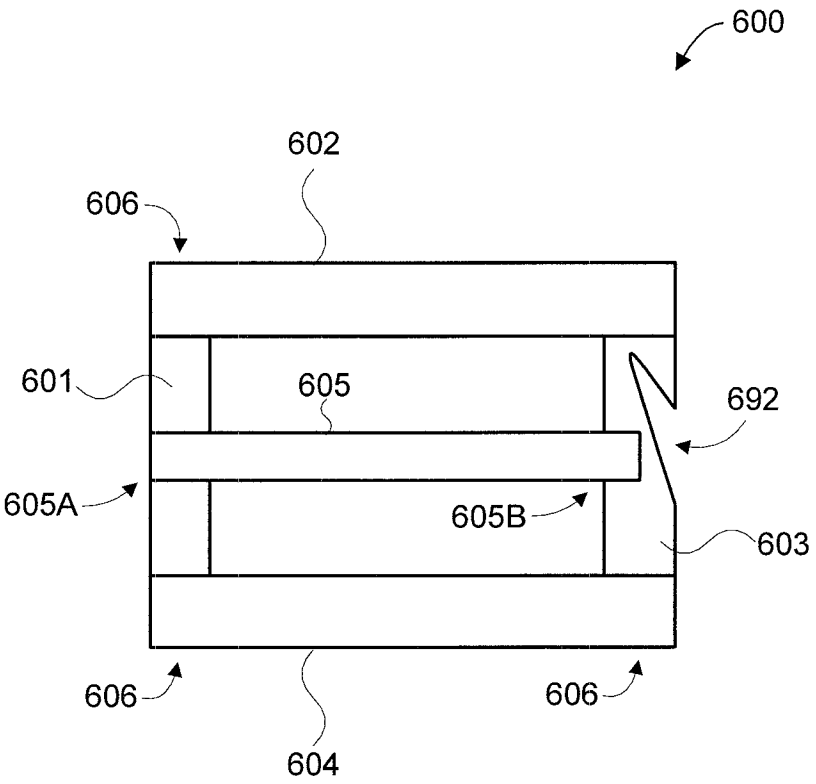
FIG. 6 is a diagram showing an exemplary user configurable belt buckle 600 having a bottle opener 692, in accordance with an embodiment of the present principles.

FIG. 6 is a diagram showing another exemplary user configurable belt buckle 600, in accordance with an embodiment of the present principles. The user configurable belt buckle 600 includes a left side 601, a top side 602, a right side 603, a bottom side 604, and a prong 605. The elements (e.g., 601, 602, 603, and 604) are interconnected using fasteners 606 (not all fasteners are indicated in FIG. 6). Moreover, side 605A of prong 605 is attached to the left side 601, and side 605B of prong 605 goes through a hole in a corresponding belt in order to secure a desired belt length.

In the embodiment of FIG. 6, one side of the user configurable belt buckle 600 includes a feature. Specifically, the feature is a bottle opener 692 on the right side 603. Accordingly, the user configurable belt buckle 600 provides the advantageous feature of a bottle opener 692 without the wearer having to carry a separate item to obtain the benefits of the same.

Figure 7:
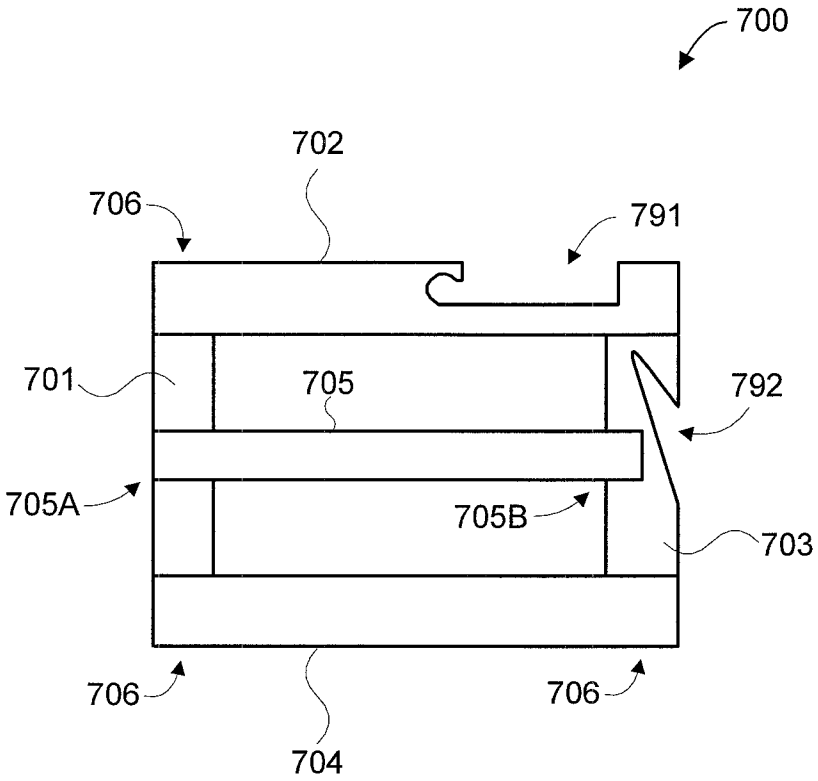
FIG. 7 is a diagram showing an exemplary user configurable belt buckle 700 having a seat belt cutter 791 and a bottle opener 792, in accordance with an embodiment of the present principles.

FIG. 7 is a diagram showing yet another exemplary user configurable belt buckle 700, in accordance with an embodiment of the present principles. The user configurable belt buckle 700 includes a left side 701, a top side 702, a right side 703, a bottom side 704, and a prong 705. The elements (e.g., 701, 702, 703, and 704) are interconnected using fasteners 706 (not all fasteners are indicated in FIG. 7). Moreover, side 705A of prong 705 is attached to the left side 701, and side 705B of prong 705 goes through a hole in a corresponding belt in order to secure a desired belt length.

In the embodiment of FIG. 7, two sides of the user configurable belt buckle 700 include a respective feature. Specifically, the top side 702 includes as a feature a seatbelt cutter 791, and the right side 703 includes as a feature a bottle opener 792. Accordingly, the user configurable belt buckle 700 provides the advantageous and potentially life-saving feature of a belt cutter 791 that can be used to cut a seat belt to thereby free a trapped occupant of a vehicle, and also provides the advantageous feature of a bottle opener 792 without the wearer having to carry a separate item to obtain the benefits of the same.

Figure 8:
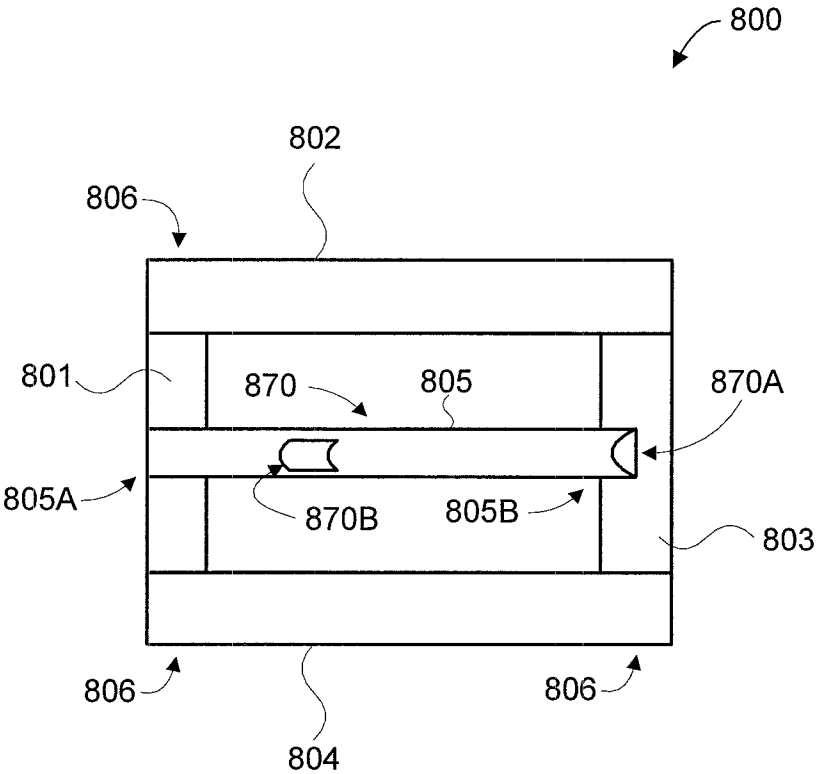
FIG. 8 is a diagram showing an exemplary user configurable belt buckle 800 having a whistle 870, in accordance with an embodiment of the present principles.

FIG. 8 is a diagram showing an exemplary user configurable belt buckle 800, in accordance with an embodiment of the present principles. The user configurable belt buckle 800 includes a left side 801, a top side 802, a right side 803, a bottom side 804, and a prong 805. The elements (e.g., 801, 802, 803, and 804) are interconnected using fasteners 506 (not all fasteners are indicated in FIG. 8). Moreover, side 805A of prong 805 is attached to the left side 801, and side 805B of prong 805 goes through a hole in a corresponding belt in order to secure a desired belt length.

In the embodiment of FIG. 8, one side of the user configurable belt buckle 800 includes a feature. Specifically, the feature is a whistle 870 implemented in the prong 805. The whistle 870 includes an air inlet 870A and an air outlet 870B. The user can lift the buckle to his/her lips and blow into the air inlet 870A whereby a whistle is emitted from the air outlet 870B. Of course, given the modularity of buckle 800, the whistle 870 (prong 805) can be removed from the frame of the buckle and used separately (i.e., unattached to the buckle 800). Accordingly, the user configurable belt buckle 800 provides the advantageous and potentially life-saving feature of a whistle 870 that can be used to call for help or simply obtain attention.

Figure 9:
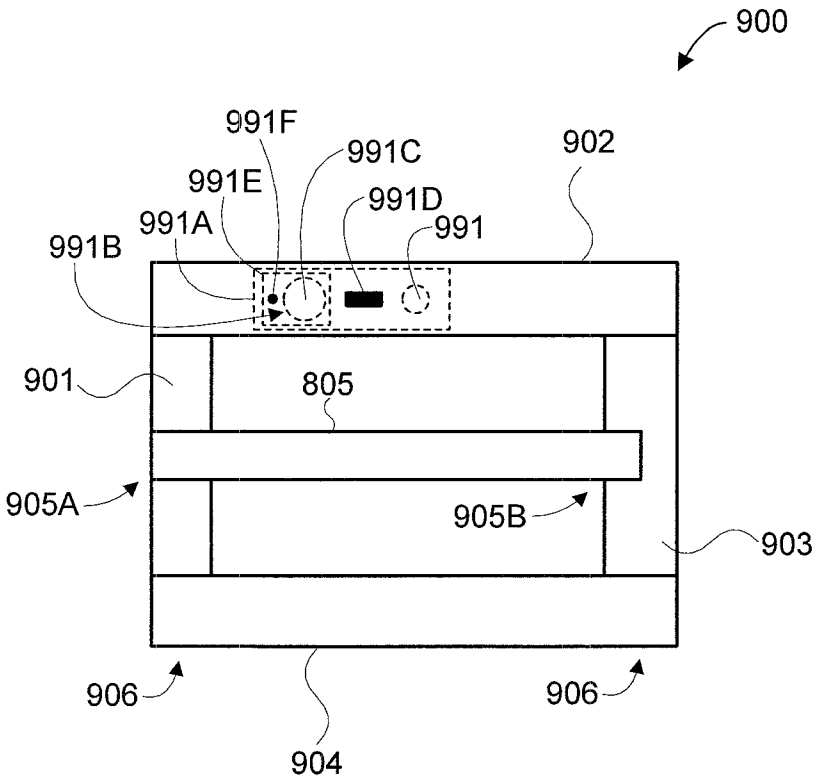
FIG. 9 is a diagram showing an exemplary user configurable belt buckle 900 having an LED 991, in accordance with an embodiment of the present principles.

FIG. 9 is a diagram showing yet another exemplary user configurable belt buckle 900, in accordance with an embodiment of the present principles. The user configurable belt buckle 900 includes a left side 901, a top side 902, a right side 903, a bottom side 904, and a prong 805. The elements (e.g., 901, 902, 903, and 904) are interconnected using fasteners 906. Moreover, side 905A of prong 905 is attached to the left side 901, and side 905B of prong 905 goes through a hole in a corresponding belt in order to secure a desired belt length.

In the embodiment of FIG. 9, one side of the user configurable belt buckle 900 includes a feature. Specifically, the feature is a light emitting diode (LED) 991 located on the top side 902. The LED 991 is powered by, and mounted on, a circuit board 991A having a receiving portion 991B for receiving and connecting to a battery 991C in order to power the LED. The battery 991C can be any miniature size battery, depending upon the particular implementation of the buckle 900. A switch 991D is accessible by the user on the front (outward facing portion) of the top side 902. In another embodiment, the switch 991D can be accessible by the user on the top (the plane facing upwards towards the face of the user) of the top side 902. The battery 992B is placed into the receiving portion 991B through a trap door 991E on the back (rearward facing portion) of the top side 902. The trap door 991E is opened using a fastener 991F (e.g., a screw or any type of fastener).

If the fasteners 906 and/or fastener 991F are/is magnetic, then consideration is to be given regarding its effect on the electronics. Accordingly, shielding may be employed on (e.g., around) either the electronics and/or the fasteners to prevent affecting the operation of the electronics.

Moreover, inductive coupling can be used to couple a powered side (a side that includes a power source such as a battery) to a non-powered side in order to power an LED (or other electronic device) on the non-powered side, thus avoiding direct wiring connections between two sides while providing power from one side to the other. For example, a coil(s) can be used on a non-powered side to provide power to an LED on a non-powered side from the magnetics used to couple the powered side to the non-powered side in the case that fasteners 906 are magnetic.

While one LED 991 is shown, it is to be appreciated that other embodiments of the present principles can include more than one LED. Such multiple LEDs can be arranged on different portions of the buckle, and so forth.

Moreover, in an embodiment, the battery 991C can be a rechargeable battery. In an embodiment, the circuit board 991A can be configured to receive a miniaturized connector on the end of a power cord that includes a step-down transformer for taking conventional voltages (e.g., 110 VAC, 220 VAC) and converting the same to a lower voltage for use in providing a charge to a rechargeable battery.

The particular circuitry of the circuit board 991A is not shown, but is readily understood and implemented by one of ordinary skill in the electrical arts, given the teachings of the present principles provided herein, while maintaining the spirit of the present principles. The aforementioned and other variations of an LED-based implementation of a user configurable belt buckle in accordance with the present principles are readily determined by one of ordinary skill in the art, given the teachings of the present principles provided herein, while maintaining the spirit of the present principles.

Accordingly, the user configurable belt buckle 900 provides the advantageous feature of an LED 991, thus providing illumination and so forth as readily appreciated by one of ordinary skill in the art, given the teachings of the present principles provided herein, while maintaining the spirit of the present principles.

Figure 10:
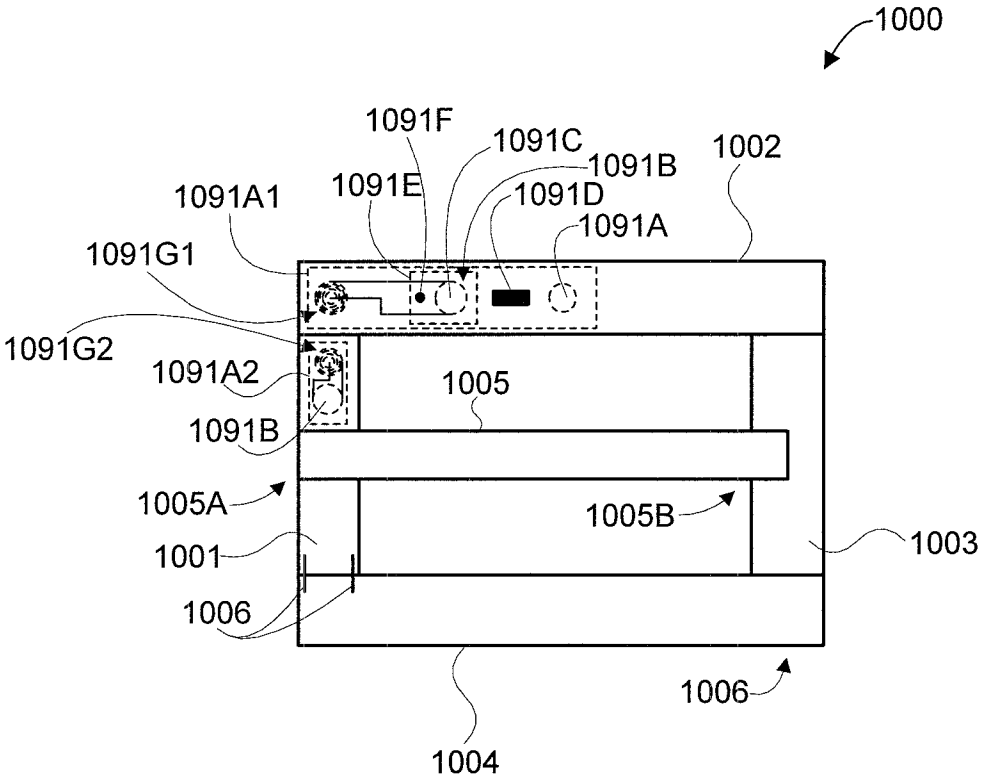
FIG. 10 is a diagram showing an exemplary user configurable belt buckle 1000 having two LEDs 1091A and 1091B, with LED 1091B powered via inductive coupling, in accordance with an embodiment of the present principles.

FIG. 10 is a diagram showing yet another exemplary user configurable belt buckle 1000, in accordance with an embodiment of the present principles. The user configurable belt buckle 1000 includes a left side 1001, a top side 1002, a right side 1003, a bottom side 1004, and a prong 1005. The elements (e.g., 1001, 1002, 1003, and 1004) are interconnected using fasteners 1006. Moreover, side 1005A of prong 1005 is attached to the left side 1001, and side 1005B of prong 1005 goes through a hole in a corresponding belt in order to secure a desired belt length.

In the embodiment of FIG. 10, one side of the user configurable belt buckle 1000 includes a feature. Specifically, the feature is two light emitting diodes (LED) 1091A and 1091B located on the top side 1002 and left side 1001, respectively. The LED 1091A is powered by, and mounted on, a circuit board 1091A1 having a receiving portion 1091B for receiving and connecting to a battery 1091C in order to power the LED 1091A. The battery 1091C can be any miniature size battery, depending upon the particular implementation of the buckle 1000. A switch 1091D is accessible by the user on the front (outward facing portion) of the top side 1002. In another embodiment, the switch 1091D can be accessible by the user on the top (the plane facing upwards towards the face of the user) of the top side 1002. The battery 1092B is placed into the receiving portion 1091B through a trap door 1091E on the back (rearward facing portion) of the top side 1002. The trap door 1091E is opened using a fastener 1091F (e.g., a screw or any type of fastener).

In the embodiment of FIG. 1010, inductive coupling can be used to couple a powered side (a side that includes a power source such as a battery), here top side 1002, to a non-powered side, here side left side 1001, in order to power an LED 1091 (or other electronic device) on the non-powered left side 1001, thus avoiding direct wiring connections between two sides while providing power from one side (top side 1002) to the other side (left side 1001). For example, a coil 1091G1 on powered top side 1002 (s) and a coil 1091G2 on non-powered left side 1001 can be used to power LED 1091B on non-powered left side 1001 via inductive coupling.

In the embodiment of FIG. 10, the fasteners 1006 can be arranged to extend outside the periphery of the circuit board 1091A2 (not shown, but shown further down left side 1001 for the sake of clarity).

Figure 11:
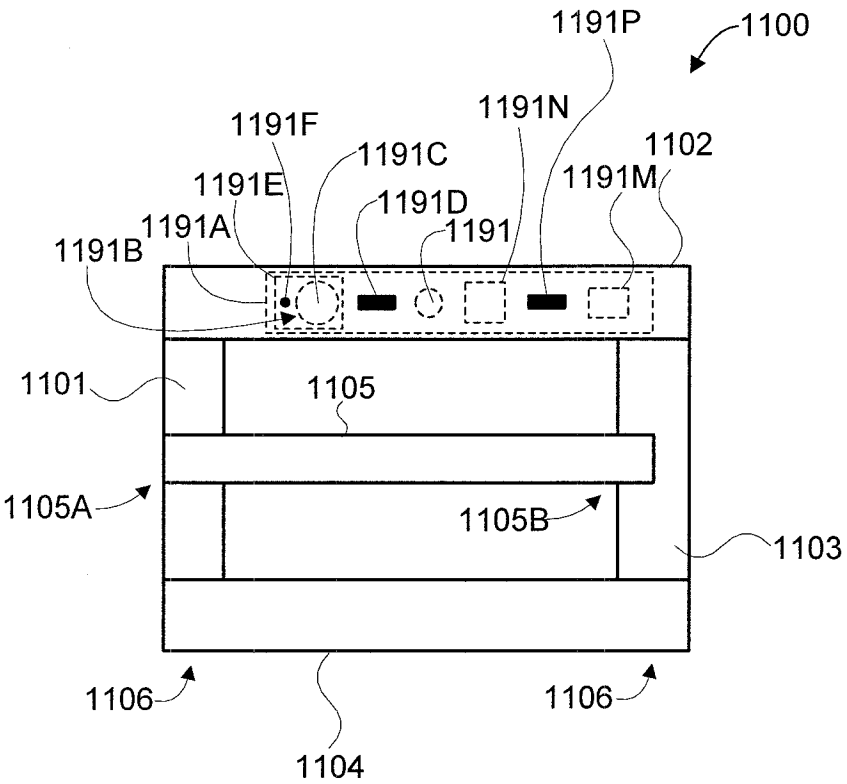
FIG. 11 is a diagram showing an exemplary user configurable belt buckle 1100 having a programmable LED 1191, in accordance with an embodiment of the present principles.

FIG. 11 is a diagram showing yet another exemplary user configurable belt buckle 1100, in accordance with an embodiment of the present principles. The user configurable belt buckle 1100 includes a left side 1101, a top side 1102, a right side 1103, a bottom side 1104, and a prong 1105. The elements (e.g., 1101, 1102, 1103, and 1104) are interconnected using fasteners 1106. Moreover, side 1105A of prong 1105 is attached to the left side 1101, and side 1105B of prong 1105 goes through a hole in a corresponding belt in order to secure a desired belt length.

In the embodiment of FIG. 11, one side of the user configurable belt buckle 1100 includes a feature. Specifically, the feature is a light emitting diode (LED) 1191 located on the top side 1102. The LED 1191 is configurable as described below.

The LED 1191 is powered by, and mounted on, a circuit board 1191A having a receiving portion 1191B for receiving and connecting to a battery 1191C in order to power the LED 1191. The battery 1191C can be any miniature size battery, depending upon the particular implementation of the buckle 1100. A switch 1191D is accessible by the user on the front (outward facing portion) of the top side 1102. In another embodiment, the switch 1191D can be accessible by the user on the top (the plane facing upwards towards the face of the user) of the top side 1102. The battery 1192B is placed into the receiving portion 1191B through a trap door 1191E on the back (rearward facing portion) of the top side 1102. The trap door 1191E is opened using a fastener 1191F (e.g., a screw or any type of fastener).

The configurability of LED 1191 will now be described.

It is to be appreciated that LED embodiments can include a strobe function, in addition to a constant on and constant off via a three position switch or any other type of actuator as known in the art. Hence, switch 1191D can be such a switch or any type of switch applicably to the particular implementation, as readily appreciated by one of ordinary skill in the art. The strobe function can be used for signaling, including signaling an SOS, or any other type of information.

In the embodiment of FIG. 11, the circuit board 1191A can include a circuit 1091N for implementing certain patterns in the LED 1191 and a mini-USB 1191M or other type of externally accessible communication port for interfacing with a computer or cellular phone or tablet or laptop, etc. in order to program the pattern(s) into the circuit 1091N. Hence, the LED 1191 can thus programmed to implement one or more patterns. A separate switch 1191P can even be used to switch between different patterns. The pattern can include one or more digital words in order to provide communication capability to the buckle 1100. For example, an SOS pattern, or even an identifying pattern for identifying a particular individual can be implemented. These and other types of patterns are readily contemplated by one of ordinary skill in the art, given the teachings of the present principles provided herein, while maintaining the spirit of the present principles.

In an embodiment, the LED 1191 (or LED 991, or one or both of the LEDs 1091A and 1091B) can provide infrared emission, thus having an emission that is invisible to the naked eye. Such emission can be used for many applications. An exemplary application can be troop or individual identification. For example, friendly troops in an area can be identified by a particular frequency of emission and/or pattern (e.g., particular digital word). Such identification can be made through appropriate viewing devices such as night vision goggles, a night vision monocular, and so forth. These and other exemplary applications are readily determined by one of ordinary skill in the art, given the teachings of the present principles provided herein, while maintaining the spirit of the present principles.

Figure 12:
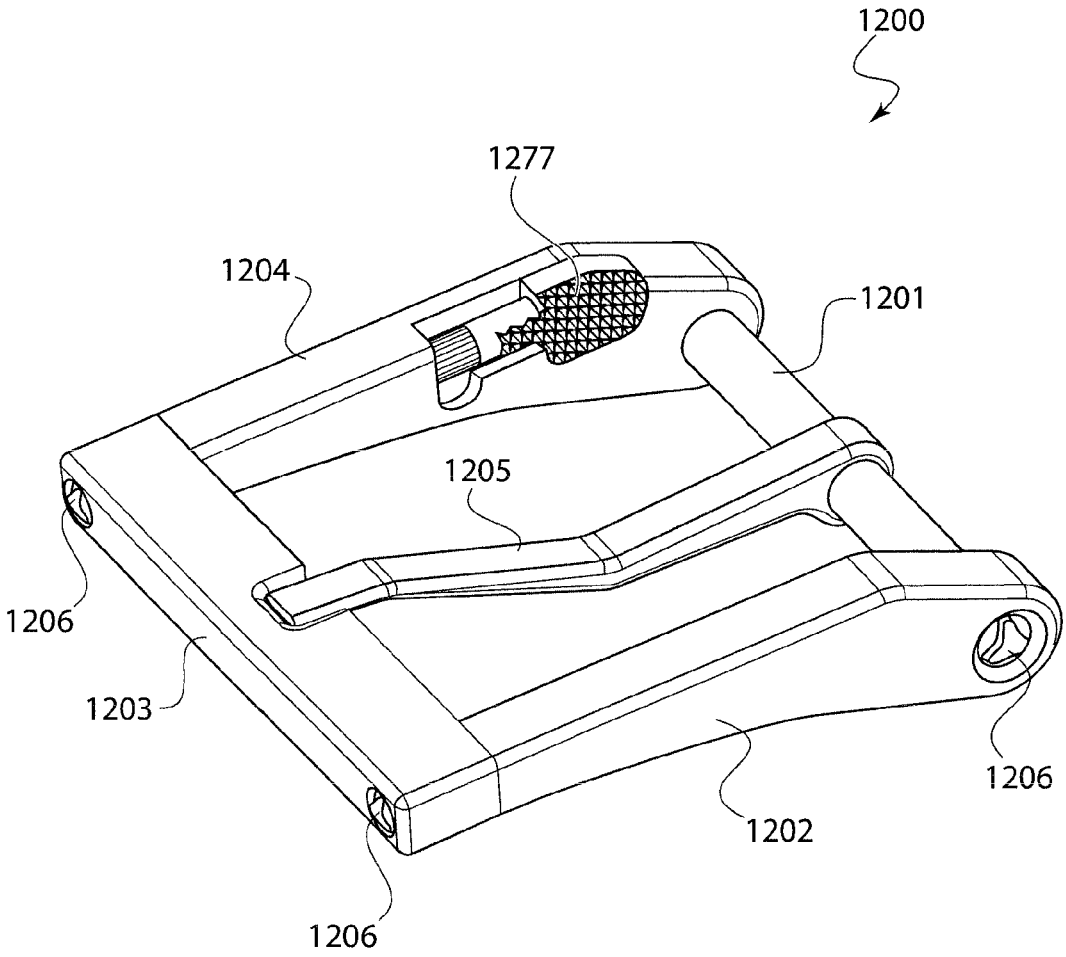
FIG. 12 is a perspective view showing an exemplary user configurable belt buckle 1200 having a removable handcuff key 1290, in accordance with an embodiment of the present principles.
Figure 13:
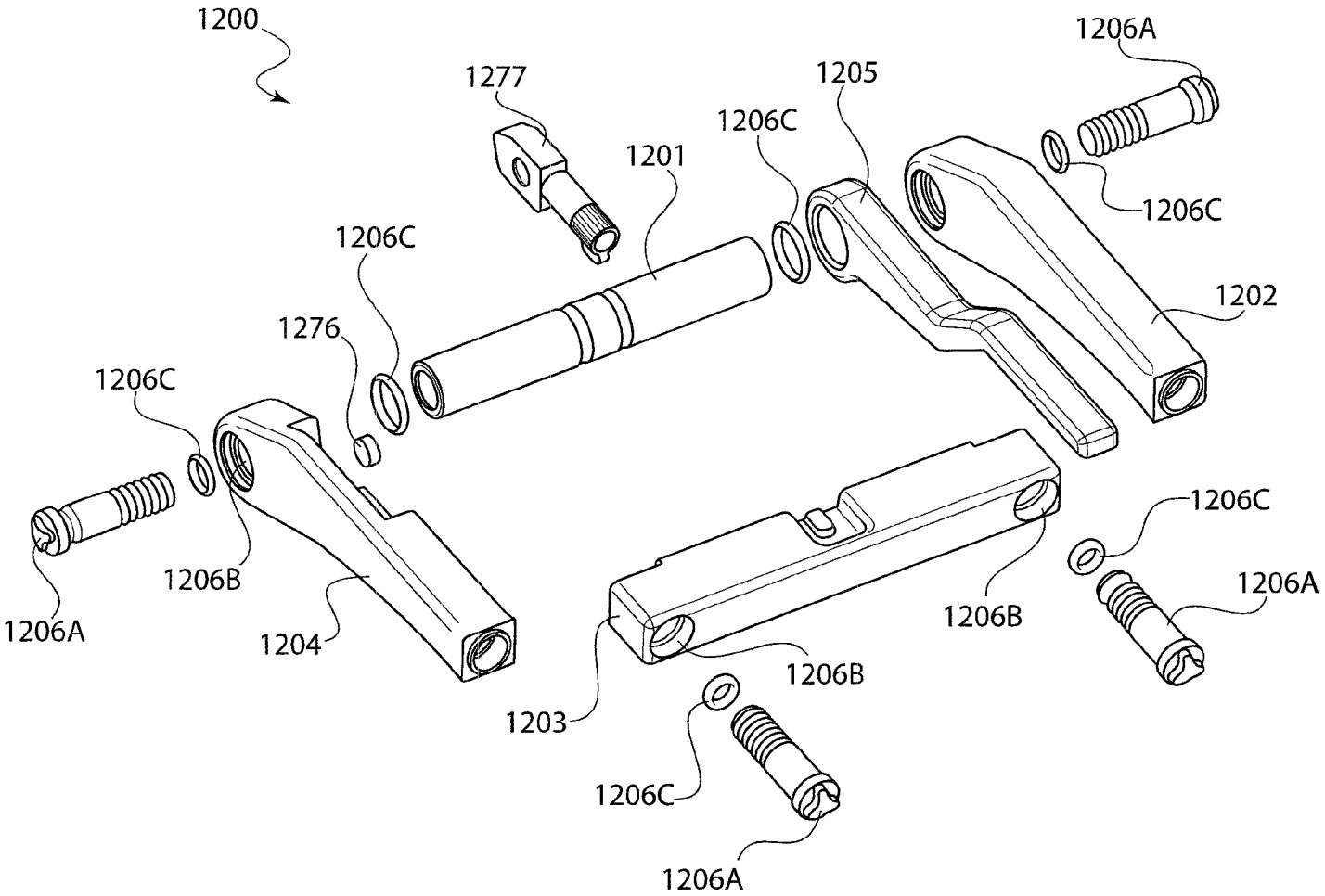
FIG. 13 is an exploded perspective view showing the exemplary user configurable belt buckle 1200 of FIG. 12, in accordance with an embodiment of the present principles.

FIG. 12 is a perspective view showing an exemplary user configurable belt buckle 1200 having a removable handcuff key 1277, in accordance with an embodiment of the present principles. FIG. 13 is an exploded perspective view showing the exemplary user configurable belt buckle 1200 of FIG. 12, in accordance with an embodiment of the present principles.

The user configurable belt buckle 1200 includes a left side 1201, a top side 1202, a right side 1203, a bottom side 1204, and a prong 1205. The elements (e.g., 1201, 1202, 1203, and 1204) are interconnected using fasteners 1206. In the embodiment of FIG. 12, the fasteners 1206 include screws 1206A and screw receiving portions 1206B. While the screws 1206A and screw receiving portions 1206B are shown having different sizes, the same sizes can be used in other embodiments. Of course, other fasteners can be used, including magnets, captive screws, and so forth. In an embodiment, an Allen key can be stored within a member of the buckle or attached to a member of the buckle (e.g., magnetically or using an attachment device, e.g., one in which the Allen key can snap into and out of). Additionally, or alternatively, a screwdriver of a type corresponding to the fasteners could be included or attached as described above for the Allen key. In an embodiment, O-rings 1206C can be used to keep water, sand, and other materials out of the internals of the user configurable belt buckle 1200. Such capability is particularly useful for embodiments that involve the inclusion of electronic elements (LED, battery, etc.) within the user configurable belt buckle 1200. The preceding description regarding the fasteners 1206 is for illustrative purposes and is not to be construed to be limiting of the present principles with regards to the fasteners that can be used to implement a user configurable belt buckle in accordance with the present principles.

The bottom side 1204 includes a protruding element 1276 for securing the handcuff key 1277 by friction such that the handcuff key 1277 can be removed from the protruding element 1276 by a user simply pulling the handcuff key 1277 away from the protruding element. Conversely, the handcuff key 1277 can be secured onto the protruding element 1276 by simply aligning a mounting hole 1277A in the handcuff key with the protruding element 1276 and pushing the handcuff key towards the bottom side 1204 so that the protruding element 1276 is within the mounting hole 1277A.

It is to be appreciated that various features beyond the functionality of securing a belt are envisioned in various embodiments of the present principles. Some exemplary features have been shown and described above. However, the present principles are not limited to the same, and many other features can be readily incorporated into a user configurable belt buckle, while maintaining the spirit of the present principles. Such features include, but are not limited to, a cigar cutter, a toothpick holder, a toothpick, a tweezers holder, a tweezers, a D-ring attachment, a rigger buckle attachment, a tool attachment, a tool kit attachment, one or more tools, an LED, a hinged door, a knife, a seatbelt cutter, a hypodermic needle, a pill holder, a whistle, and so forth.

It is to be further appreciated that the elements that form a user configurable belt buckle in accordance with the present principles can involve any known material. Exemplary materials include, but are not limited to, Aluminum, steel, Damascus, Copper, Copper Niobium, Zirconium, Timascus, moku-ti, rubber, polymer, plastic, carbon fiber, Silver, Gold, meteorite, iron, stone, bone, Cobalt, nickel, Platinum, Tungsten, fiberglass, Beryllium, and so forth.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Having described preferred embodiments of a system and method (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A user configurable belt buckle, comprising:

a user configurable frame including four side members;

a prong, secured to the user configurable frame, for protruding through a hole in a belt; and a set of user-controllable attachment devices for interconnecting the four side members and providing side member substitution, wherein at least one side member of the four side members is user replaceable by a substitute side member having at least one different physical characteristic than the at least one side member.

2. The user configurable belt buckle of claim 1, wherein the one or more user-controllable attachment devices comprise one or more magnets disposed at respective ends of at least one of, the at least one side member and adjacent side members to the at least one side member.

3. The user configurable belt buckle of claim 1, wherein the at least one different physical characteristic comprises a material, a color, a texture, and a shape.

4. The user configurable belt buckle of claim 1, wherein the at least one different physical characteristic comprises a utility feature unrelated to securing a belt.

5. The user configurable belt buckle of claim 1, wherein the prong is a user-replaceable prong secured to the one of the four side members by a user-controllable attachment device for providing prong substitution.

6. The user configurable belt buckle of claim 1, wherein the at least one different physical characteristic comprises at least one of a cigar cutter, a toothpick holder, a toothpick, a tweezers holder, a tweezers, a D-ring attachment, a rigger buckle attachment, a tool attachment, a tool kit attachment, one or more tools, a light emitting diode, a hinged door, a knife, a seatbelt cutter, a hypodermic needle, a pill holder, and a whistle.

7. The user configurable belt buckle of claim 1, wherein at least one of, the prong and at least one of the four side members, comprises a cigar cutter.

8. The user configurable belt buckle of claim 1, wherein at least one of, the prong and at least one of the four side members, comprises at least one of a toothpick holder and a toothpick.

9. The user configurable belt buckle of claim 1, wherein at least one of, the prong and at least one of the four side members, comprises at least one of a tweezers holder and a tweezers.

10. The user configurable belt buckle of claim 1, wherein at least one of, the prong and at least one of the four side members, comprises a D-ring attachment.

11. The user configurable belt buckle of claim 1, wherein at least one of, the prong and at least one of the four side members, comprises a rigger buckle attachment.

12. The user configurable belt buckle of claim 1, wherein at least one of, the prong and at least one of the four side members, comprises at least one of a tool attachment, a tool kit attachment, and one or more tools.

13. The user configurable belt buckle of claim 1, wherein at least one of, the prong and at least one of the four side members, comprises a hinged door.

14. The user configurable belt buckle of claim 1, wherein at least one of, the prong and at least one of the four side members, comprises a knife.

15. The user configurable belt buckle of claim 1, wherein at least one of, the prong and at least one of the four side members, comprises a seatbelt cutter.

16. The user configurable belt buckle of claim 1, wherein at least one of, the prong and at least one of the four side members, comprises a hypodermic needle.

17. The user configurable belt buckle of claim 1, wherein at least one of, the prong and at least one of the four side members, comprises a pill holder.

18. The user configurable belt buckle of claim 1, wherein at least one of, the prong and at least one of the four side members, comprises a whistle.

19. The user configurable belt buckle of claim 1, wherein at least one of, the prong and at least one of the four side members, comprises a handcuff key.

20. The user configurable belt buckle of claim 1, wherein at least one of, the prong and at least one of the four side members, comprises at least one light emitting diode.

21. The user configurable belt buckle of claim 20, wherein an emission pattern of, at least one of, the at least one light emitting diode is programmable via an externally accessible communication port.

22. The user configurable belt buckle of claim 21, wherein the emission pattern visually represents one or more programmed digital words.

23. The user configurable belt buckle of claim 20, wherein an emission of the at least one light emitting diode is infrared.

24. The user configurable belt buckle of claim 23, wherein the emission identifies an individual.

25. The user configurable belt buckle of claim 23, wherein the emission identifies an individual as a member of a particular group.

26. The user configurable belt buckle of claim 20, wherein an emission of the at least one light emitting diode identifies an individual.

27. The user configurable belt buckle of claim 20, wherein an emission of the at least one light emitting diode identifies an individual as a member of a particular group.

28. The user configurable belt buckle of claim 20, wherein the at least one light emitting diode comprises at least one light emitting diode on one of the four side members, and at least another one light emitting diode on another one of the four side members powered via inductive coupling.

29. A user configurable belt buckle kit, comprising:

a user configurable frame including four side members;

a prong secured to the user configurable frame;

at least one of, (i) one or more substitute side members and (ii) a substitute prong;

a set of user-controllable side attachment devices that interconnect the four side members and provide side member substitution; and a user-controllable prong attachment that connects the prong to one of the four side members and provides prong substitution, wherein the prong and at least one side member of the four side members are user replaceable.

* * * * *